US007648812B2

(12) United States Patent
Umehara

(10) Patent No.: US 7,648,812 B2
(45) Date of Patent: Jan. 19, 2010

(54) TONER, DEVELOPER, AND IMAGE FORMING APPARATUS

(75) Inventor: Ken Umehara, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 525 days.

(21) Appl. No.: 11/496,486

(22) Filed: Aug. 1, 2006

(65) Prior Publication Data

US 2007/0141498 A1 Jun. 21, 2007

(30) Foreign Application Priority Data

Aug. 1, 2005 (JP) ..... 2005-223521

(51) Int. Cl.
*G03G 9/087* (2006.01)

(52) U.S. Cl. ..... 430/108.21; 430/108.2; 430/109.4

(58) Field of Classification Search ..... 430/108.2, 430/108.21, 109.4, 110.1
See application file for complete search history.

(56) References Cited

U.S. PATENT DOCUMENTS

2005/0136353 A1* 6/2005 Sato et al. ..... 430/109.4

FOREIGN PATENT DOCUMENTS

JP 04-362956 12/1992
JP 2003-057875 2/2003
JP 2004-151535 5/2004
JP 2004-151709 5/2004
JP 2004-302458 10/2004
JP 2004-309517 11/2004
JP 2005-164800 6/2005

OTHER PUBLICATIONS

Chem Draw citation for oleic amide (no date).*
Chem Draw citation for ethylene biscapric amide (no date).*

* cited by examiner

*Primary Examiner*—Christopher RoDee
(74) *Attorney, Agent, or Firm*—Oblon, Spivak, McClelland, Maier & Neustadt, L.L.P.

(57) ABSTRACT

A toner is provided including a binder resin; a release agent; a colorant; and a fatty acid amide compound, wherein the binder resin includes: an amorphous polyester (A) having a softening point of from 70 to 140° C.; an amorphous polyester (B) having a softening point of from 120 to 190° C.; and a crystalline polyester (C), and wherein the following relationship is satisfied: TmC<Tm(Asp), wherein TmC represents a softening point of the crystalline polyester (C) and Tm (Asp) represents a softening point of the fatty acid amide compound; and a developer and an image forming apparatus using the toner.

14 Claims, 1 Drawing Sheet

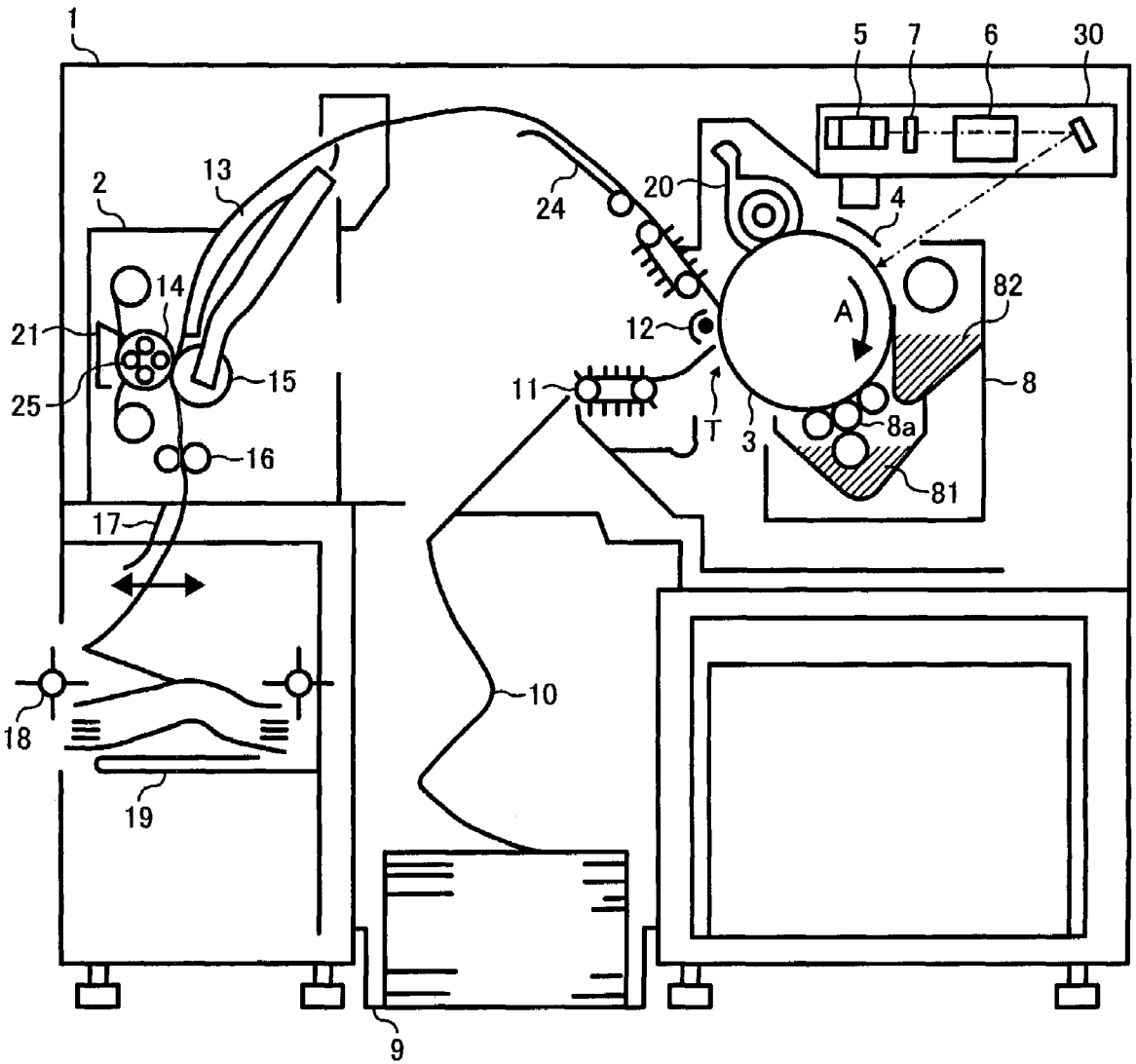
FIGURE

TONER, DEVELOPER, AND IMAGE FORMING APPARATUS

BACKGROUND OF THE INVENTION

1. Field of the Invention

The present invention relates to a toner and a developer for use in electrophotography. In addition, the present invention also relates to an image forming apparatus using the toner.

2. Discussion of the Background

Electrophotography is generally used for image forming apparatuses such as laser printers and dry electrostatic copiers. In electrophotography, an image is formed as follows:

(1) uniformly charging a photoconductive insulating layer (i.e., a charging process);
(2) partially irradiating the photoconductive insulating layer with light to dissipate charges, to form an electrostatic latent image (i.e., an irradiating process);
(3) adhering a toner, which is typically a colored and charged particulate material, to the electrostatic latent image to form a visible image (i.e., a developing process);
(4) transferring the visible image onto a transfer material such as a transfer paper (i.e., a transferring process); and
(5) permanently fixing the visible image onto the transfer material upon application of heat, pressure, and the like (i.e., a fixing process).

In the fixing process, for example, contact heat fixing methods (such that a toner is heat-melted using a heat roller) and non-contact heat fixing methods (such as oven fixing) are used. Recently, since a demand for energy saving increases, copiers are also required to reduce electrical power consumption in the fixing process, which is occupying the most part of the total electrical power consumption in the copier. The contact heat fixing methods have an advantage over the non-contact heat fixing methods in terms of thermal efficiency, and therefore a toner can be fixed at relatively low temperature, resulting in energy saving and downsizing of the apparatus.

However, the contact heat fixing methods tend to cause an offset problem in that part of a fused toner image is adhered and transferred to the surface of the heat roller, and then part of the toner image is retransferred to the following sheet of a transfer material.

In attempting to prevent occurrence of the offset problem, a technique in which the surface of the heat roller is covered with a material having high releasability such as fluorocarbon resins, and a technique in which a fixing oil, such as a silicon oil, is applied to the surface of the heat roller, have been proposed. However, in the latter case, since a fixing device needs a fixing oil applying system, the fixing device upsizes and the fixing system becomes complicated. As a result, manufacturing costs and operation costs increase, and various troubles are likely to be caused.

Moreover, in attempting to prevent occurrence of the offset problem, a technique in which the temperature of a heat roller is decreased is proposed. However, in this case, a toner cannot be sufficiently melted, i.e., the toner cannot be sufficiently fixed.

In terms of energy saving and downsizing of apparatus, toners are required to have good hot offset resistance and good low temperature fixability. In addition, toners are required to have a property such that a toner does not cause a blocking problem even when the toner is stored at the temperature inside an apparatus (this property is hereinafter referred to as thermostable preservability).

Japanese Patent No. 3142297 discloses a toner including two kinds of binder resins having different softening points.

In this case, as the amount of a resin having lower softening point increases, low temperature fixability of the toner improves, but the thermostable preservability and hot offset resistance thereof deteriorate. In addition, as the glass transition temperature of the resin having lower softening point increases, the thermostable preservability of the toner improves, but the toner cannot have a good combination of low temperature fixability and hot offset resistance even if the amount of the resin having lower softening point is increased. Moreover, since the difference between the softening point of the resin having lower softening point and the minimum fixing temperature at which the toner can be fixed is too large, the toner cannot be sharply melted at such a low fixing temperature. Because of these reasons, a need exists for a toner having better low temperature fixability and better hot offset resistance.

Published unexamined Japanese patent application No. (hereinafter referred to as JP-A) 2004-302458 discloses a toner including a crystalline polyester resin as a binder resin, which is manufactured by the following method: dissolving or dispersing toner constituents including the crystalline polyester resin and a modified polyester resin capable of reacting with a compound having an active hydrogen group, in an organic solvent to prepare a toner constituent mixture liquid; and dispersing the toner constituent mixture liquid in an aqueous medium containing a particulate resin while reacting the modified polyester resin with a cross-linking agent and/or an elongation agent to prepare toner particles. The crystalline polyester resin has a thermal property such that viscosity thereof rapidly decreases at a temperature at which the toner starts to be fixed, due to its crystallinity. For this reason, the toner shows good thermostable preservability until the toner is melted, and the toner has a sharp melting property, and is fixed on a transfer material because the crystalline polyester resin starts to rapidly decrease its viscosity at the melting point. It is described in JP-A 2004-302458 that such a toner has a good combination of thermostable preservability and low temperature fixability.

JP-A 2003-57875 discloses a toner including a binder resin including the following three kinds of resins: a resin (A) having a softening point of from 120 to 170° C. and a glass transition temperature of from 58 to 75°0 C., and including chloroform insoluble components in an amount of from 5 to 50% by weight; a resin (B) having a softening point of from 90 to 120° C. and a glass transition temperature of from 58 to 75° C.; and a crystalline polyester resin (C) having a melting point of from 80 to 140° C., wherein the binder resin includes chloroform insoluble components in an amount of less than 30% by weight. Further, the toner includes a wax (W) having a penetration of not less than 1.5 and a melting point of from 80 to 110° C. These toner constituents are melt-kneaded, and as a result, the crystalline polyester resin (C) serving as a low melting point material is uniformly dispersed in the resins (A) and (B) having different softening points. It is described in JP-A 2003-57875 that such a toner has a good combination of low temperature fixability, hot offset resistance, and thermostable preservability.

JP-A 2004-151709 discloses a toner including (1) a crystalline polymer having a melting point of from 180 to 280° C. and a thermal property such that the heat quantity at an endothermic peak (determined by a differential scanning calorimeter (DSC)) observed at the melting point is from 25 to 150 mJ/mg and (2) an amorphous polyester having a glass transition temperature of from 30 to 80° C., wherein the amorphous polyester includes an amorphous polyester having a weight average molecular weight of from 3,000 to 20,000 and an amorphous polyester having a weight average molecular weight of from 30,000 to 300,000. In such a toner, crystalline portions of the crystalline polymer form a physical cross-linking structure in the amorphous polyester, and on the other hand, amorphous portions of the crystalline polymer and the amorphous polyester are twisted together, resulting in formation of a kind of a network structure in the toner. It is described in JP-A 2004-151709 that the decreasing rate of viscosity of such a toner at high temperatures is low, and therefore a toner having a good combination of low temperature fixability, hot offset resistance, thermostable preservability, and an ability to produce images having good coloring power is provided.

JP-A 2005-164800 discloses a toner including at least a first binder resin (LR), a second binder resin (HR), and a crystalline resin, wherein the toner satisfies the following relationships: $90 \leqq Tlr3 \leqq 125$, $155 \leqq Thr3 \leqq 210$, and $95 \leqq Tcr3 \leqq 150$, wherein Tlr3(°C.) represents a temperature at which the first binder resin (LR) has a viscosity of $1\times10^3$ (Pa·s), Thr3 (° C.) represents a temperature at which the second binder resin (HR) has a viscosity of $1\times10^3$ (Pa·s), and Tcr3(°C.) represents a temperature at which the crystalline resin (CR) has a viscosity of $1\times10^3$ (Pa·s). It is described in JP-A 2005-164800 that such a toner can produce high quality images, and has a wide fixable temperature range and good thermostable preservability.

As mentioned above, JP-As 2004-302458, 2003-57875, 2004-151709, and 2005-164800 have disclosed toners including two amorphous polyester resins and a crystalline polyester resin. In these toners, properties of each of the plural resins are maintained in the toner even if these resins have greatly different softening points. However, once these toners are heated, the amorphous polyester resins and the crystalline polyester resin are melted and mixed with each other (i.e., these resins become compatible with each other), and properties of each of the plural resins disappear in the melted toner.

In attempting to solve this problem, JP-A 2004-309517 discloses a toner manufacturing method in which a crystalline resin (100 parts by weight) having a ratio of the softening point to the temperature at which the maximum of the DSC peak representing the melting heat thereof is observed of from 0.6 to 1.3, and a particulate inorganic material (from 0.1 to 10 parts by weight) having a particle diameter of from 20 nm to 3 μm are melt-kneaded. It is described in JP-A2004-309517 that the crystalline resin can easily crystallize by being melt-kneaded together with the particulate inorganic material having a predetermined particulate diameter, thereby providing a toner having good low temperature fixability. However, chargeability of such a toner is changed due to existence of the particulate inorganic material. In addition, since elastic modulus of the toner is also changed due to existence of the particulate inorganic material, the shapes of the toner particles vary, and therefore a problem such that each of the toner particles has different fixing property is caused.

By the way, recently, two-component developing methods using a two-component developer consisting of a carrier and a toner (hereinafter referred to as a developer) is mainly used when the above-mentioned toners are used, in terms of transferability, reproducibility of halftone images, and stability of developability under various temperature and humidity.

In a developing device using a two-component developer, the developer forms magnetic brushes on a developer bearing member while being held thereon. The magnetic brushes (i.e., developer) are transported to a developing region in which the developer bearing member and a latent image bearing member are facing. In the developing region, the magnetic brushes rub the surface of the latent image bearing member so that a toner included in the developer is supplied to an electrostatic latent image. Thus, the electrostatic latent image is developed with the toner. This method is called a magnetic brush developing method.

In the magnetic brush developing methods, as the average particle diameter of the carrier decreases, reproducibility of latent images increases. As a result, high quality images having good reproducibility of letters and good granularity (which represents a visual smoothness of letters) can be produced. Namely, when a carrier having a small particle diameter is used in the magnetic brush developing method, a latent image can be faithfully reproduced, and therefore a high definition image can be easily produced.

On the other hand, as the average particle diameter of the carrier decreases, a magnetic force per particle of the carrier decreases. As a result, a problem such that the carrier adheres to a non-image portion of the latent image formed on the latent image bearing member tends to be caused. (This phenomenon is hereinafter referred to as carrier adherence.)

The reason for the carrier adherence is considered to be as follows. Typically, a carrier is held on a developing sleeve (i.e., the surface of a developing bearing member) due to its magnetism. Simultaneously, the carrier is elecrostatically influenced by charges of an image bearing member because of having a charge. When the electrostatic force acting on the carrier and the image bearing member overcomes the magnetic force acting on the carrier and the developing sleeve, the carrier moves onto the image bearing member.

When the carrier adherence occurs, the quality of the produced image deteriorates. For example, when carrier particles adhered to an image bearing member are transferred and fixed onto a transfer material (such as a paper), an image having noise is produced. When such carrier particles are not transferred onto a transfer material, an image having white spots is produced.

Carrier adherence is more likely to be caused when the image forming speed is high. As the image forming speed increases, the linear speed of a developing sleeve increases, resulting in increase of a centrifugal force acting on a developer held on the developing sleeve. As a result, magnet brushes (i.e., the developer) give a lager impact to the surface of an image bearing member, and therefore a carrier included in the magnet brushes tend to release therefrom.

Recently, high-speed image forming apparatuses are widely used. However, as mentioned above, if carrier particles release from magnet brushes held on a developing sleeve, the released carrier particles adhere to an image bearing member, resulting in carrier adherence.

The carrier particles adhered on the image bearing member cause a problem such that abnormal images such as white spots are produced. Another problem is also caused such that the carrier particles adhered on the image bearing member damage image forming members arranged around the image bearing member.

In attempting to prevent carrier adherence when a carrier having a small particle diameter is used, JP-A 2000-172078 discloses an image forming method using a developer bearing member containing magnetic poles therein of which a main pole has a magnet force of not less than 100 mT, and a developer including a carrier having a volume average particle diameter of not greater than 50 μm, wherein the process speed thereof is not less than 200 mm/sec. It is described in JP-A2000-172078 that when an image bearing member contains magnetic poles therein of which a main pole has a relatively large magnet force, carrier adherence tends not to occur even in such a high-speed image forming method using a two-component developer including a carrier having a small particle diameter.

However, it is still difficult to completely prevent carrier adherence even in such an image forming method. There is a problem such that a part of a toner on the developer bearing member cannot move to an image bearing member because the developing bearing member has too strong a magnetic force. As a result, fogging is observed on the resultant images. In addition, manufacturing cost of the apparatus increases because of loading magnetic poles therein.

Because of these reasons, a need exists for an image forming apparatus utilizing a two-component developing method which does not produce abnormal images (caused by carrier adherence), and produces high definition and high quality images.

SUMMARY OF THE INVENTION

Accordingly, an object of the present invention is to provide a toner having a good combination of low temperature fixability, hot offset resistance, and thermostable preservability.

Another object of the present invention is to provide a developer which does not cause carrier adherence.

Another object of the present invention is to provide a high-speed image forming apparatus which can produce high quality images for a long period of time.

These and other objects of the present invention, either individually or in combinations thereof, as hereinafter will become more readily apparent can be attained by a toner, comprising:

a binder resin;

a release agent;

a colorant; and a fatty acid amide compound, wherein the binder resin comprises:

an amorphous polyester (A) having a softening point of from 70 to 140° C.;

an amorphous polyester (B) having a softening point of from 120 to 190° C.; and a crystalline polyester (C), and wherein the following relationship is satisfied:

$$TmC<Tm(Asp)$$

wherein TmC represents the softening point of the crystalline polyester (C) and Tm(Asp) represents the softening point of the fatty acid amide compound; and a developer including the toner, and an image forming apparatus using the toner.

BRIEF DESCRIPTION OF THE DRAWING

These and other objects, features and advantages of the present invention will become apparent upon consideration of the following description of the preferred embodiments of the present invention taken in conjunction with the accompanying drawing, wherein:

FIGURE is a schematic view illustrating an embodiment of the image forming apparatus of the present invention.

DETAILED DESCRIPTION OF THE INVENTION

Generally, the present invention provides a toner comprising at least a binder resin, a release agent (W), a colorant, and a fatty acid amide compound. The binder resin comprises amorphous polyesters (A) and (B) having respective softening points and a crystalline polyester (C). The following relationship (1) is satisfied:

$$TmC<Tm(Asp) \quad (1)$$

wherein TmC represents a softening point of the crystalline polyester (C), and Tm(Asp) represents a softening point of the fatty acid amide compound.

Any known amorphous polyesters manufactured by typical methods can be used as the amorphous polyesters (A) and (B). Typically, a polyester is formed by a condensation polymerization reaction between an alcohol monomer having 2 or more valences and a carboxylic acid monomer having 2 or more valences (such as carboxylic acids, carboxylic acid anhydrides, and carboxylic acid esters).

In particular, an amorphous polyester is formed by a condensation polymerization reaction using at least one of a polyol monomer having 3 or more valences and a polycarboxylic acid monomer having 3 or more valences. An amorphous polyester is also formed by a condensation polymerization reaction between a polyol monomer having 3 or more valences and a polycarboxylic acid monomer having 3 or more valences.

Specific examples of the diol monomers include, but are not limited to, alkylene oxide adducts of bisphenol A (e.g., polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane), ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adduct of bisphenol A, ethylene adduct of bisphenol A, hydrogenated bisphenol A, etc.

Among these, alkylene oxide (having 2 or 3 carbon atoms) adducts of bisphenol A (1 to 10 moles of the alkylene oxide is adducted in average), ethylene glycol, propylene glycol, 1,6-hexanediol, bisphenol A, and hydrogenated bisphenol A are preferably used.

Specific examples of the polyol monomers having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, etc.

Among these, sorbitol, 1,4-sorbitan, pentaerythritol, glycerol, and trimethylolpropane are preferably used.

The above alcohol monomers can be used alone or in combination when the amorphous polyesters (A) and (B) are produced.

Specific examples of the dicarboxylic acid monomers include, but are not limited to, all kinds of dicarboxylic acids, succinic acids substituted by an alkyl group or an alkenyl group having 1 to 20 carbon atoms, and their anhydrides and alkyl (having 1 to 12 carbon atoms) esters.

Specific examples of the above acids include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, n-dodecyl succinic acid, n-octyl succinic acid, isooctenyl succinic acid, isooctyl succinic acid, and their anhydrides and lower alkyl esters, etc.

Among these, maleic acid, fumaric acid, terephthalic acid, and succinic acids substituted by an alkenyl group having 2 to 20 carbon atoms are preferably used.

Specific examples of the polycarboxylic acid monomers having 3 or more valences include, but are not limited to, 1,2,4-benzenetricarboxylic acid,
2,5,7-naphthalenetricarboxylic acid,
1,2,4-naphthalenetricarboxylic acid,
1,2,5-hexanetricarboxylic acid,
1,3-dicarboxyl-2-methyl-2-methylenecarboxypropane,
1,2,4-cyclohexanetricarboxylic acid,
tetra (methylenecarboxyl) methane,
1,2,7,8-octanetetracarboxylic acid, pyromellitic acid, and anhydrides and lower alkyl esters of these acids, etc. Trivalent carboxylic acids and their derivatives are preferably used.

The above carboxylic acid monomers can be used alone or in combination when the amorphous polyesters (A) and (B) are produced.

Among these, 1,2,4-benzenetricarboxylic acid, and its acid anhydride and alkyl (having 1 to 12 carbon atoms) esters are preferably used.

Polyesters for use in the present invention can be obtained by an esterification reaction or an interesterification reaction using the above-mentioned monomers, and not particularly limited. Any known esterification catalyst (such as dibutyl tin oxide) can be used to accelerate the reaction.

The molecular structures of the amorphous polyesters (A) and (B) are not particularly limited. However, it is preferable that these resins are obtained by using at least one of propylene oxide adduct of bisphenol A and ethylene oxide adduct of bisphenol A as an alcohol monomer, and a compound having an unsaturated carbon-carbon double bond as an acid monomer. In particular, fumaric acid, phthalic acid, and derivatives of these acids are preferably used.

The amorphous polyester (A) has a softening point (TmA) of from 70 to 140° C., and the amorphous polyester (B) has a softening point (TmB) of from 120 to 190° C. TmA includes all values and subvalues therebetween, particularly including 80, 90, 100, 110, 120, and 130° C. TmB includes all values and subvalues therebetween, particularly including 130, 140, 150, 160, 170, and 180° C.

It is preferable that TmA is as low as possible, so long as the thermostable preservability of the resultant toner does not deteriorate. When TmA is too low, thermostable preservability of the resultant toner deteriorates. In contrast, when TmA is too high, low temperature fixability of the resultant toner deteriorates. On the other hand, when TmB is too low, hot offset resistance and thermostable preservability deteriorate. When TmB is too high, the resultant toner cannot be sufficiently fixed in a temperature range at which a fixing member is usable.

Since the binder resin includes the amorphous polyester (A) having a low softening point and the amorphous polyester (B) having a high softening point, the resultant toner has a good combination of low temperature fixability and hot offset resistance.

A softening point of a polyester can be determined by a method based on JIS K2207 (ring and ball method).

The amorphous polyester (A) preferably has a weight average molecular weight (Mw) of from 7,000 to 30,000, a number average molecular weight (Mn) of from 1,000 to 10,000, and their ratio (Mw/Mn) of from2.0 to 20.0, when a molecular weight distribution of tetrahydrofuran (THF) soluble components of the amorphous polyester (A) is determined by the gel permeation chromatography (GPC). The amorphous polyester (B) preferably has a weight average molecular weight (Mw) of from 1,000 to 200,000, a number average molecular weight (Mn) of from 1,000 to 15,000, and their ratio (Mw/Mn) of from 5.0 to 50.0, when a molecular weight distribution of tetrahydrofuran (THF) soluble components of the amorphous polyester (B) is determined by the gel permeation chromatography (GPC).

The molecular weight distribution is determined by obtaining a graph in which the logarithm of the molecular weight is plotted on the X-axis and the ratio (% by weight) is plotted on the Y-axis. It is preferable that a molecular weight peak is observed in the ratio range of from 2.5 to 15.0% by weight in each of the graphs of the amorphous polyesters (A) and (B).

It is preferable that TmA and TmB satisfy the following relationship:

$$TmA < TmB - 10° \text{ C.}$$

In this case, the toner can be fixed at much lower temperature and hot offset is not caused at much higher temperature, i.e., the toner has a wider fixable temperature range.

When TmA is not less than (TmB−10° C.), low temperature fixability and hot offset resistance deteriorate, i.e., the toner has a narrower fixable temperature range.

The toner of the present invention further comprises the crystalline polyester (C) as a binder resin together with the amorphous polyesters (A) and (B).

In the present invention, "crystallinity" is defined as a property such that a ratio of the softening point to the temperature at which the maximum of the DSC peak representing the melting heat is observed is not less than 0.9 and less than 1.1, and preferably from 0.98 to 1.05. In addition, "amorphousness" is defined as a property such that a ratio of the softening point to the temperature at which the maximum of the DSC peak representing the melting heat is observed is from 1.1 to 4.0, and preferably from 1.5 to 3.0.

An amorphous resin, which is typically used as a binder resin, starts to gradually decrease its viscosity at its glass transition temperature. There is a large difference between a glass transition temperature of a toner and a temperature at which the toner starts to be fixed (e.g., flow beginning temperature $Tf_{1/2}$). Therefore, in order to improve low temperature fixability of the toner, a softening point of the binder resin has to be decreased by decreasing the glass transition temperature or the molecular weight thereof. However, in this case, thermostable preservability and hot offset resistance of the toner deteriorate.

In contrast, the crystalline polyester (C) causes crystal transition at its glass transition temperature, and rapidly decreases its viscosity so that the toner can be fixed on a recording material such as a paper.

The toner of the present invention has a thermal property such that the viscosity thereof rapidly decreases at a temperature at which the toner starts to be fixed, because of the inclusion of the crystalline polyester (C). Namely, a toner including a crystalline polyester as a binder resin has a good combination of low temperature fixability, thermostable preservability, and hot offset resistance.

The main chain of the crystalline polyester (C) comprises a crystalline aliphatic polyester resin including the following formula (I) having an ester bond:

$$—OOC—R—COO—(CH_2)n- \quad (I)$$

wherein R represents a residue group of a straight-chain unsaturated aliphatic dicarboxylic acid having 2 to 20 carbon atoms, preferably a straight-chain unsaturated aliphatic group having 2 to 4 carbon atoms; and n represents an integer of from 2 to 20, preferably from 2 to 6.

Whether a resin includes the formula (I) can be determined by subjecting the resin to solid $C^{13}$-NMR analysis.

Specific examples of the straight-chain unsaturated aliphatic groups include, but are not limited to, straight-chain unsaturated aliphatic groups originated from straight-chain unsaturated aliphatic dicarboxylic acids such as maleic acid, fumaric acid, 1,3-n-propenedicarboxylic acid, and 1,4-n-butenedicarboxylic acid.

In the formula (I), $(CH_2)_n$ represents a residue group of a straight-chain aliphatic diol. Specific examples of the residue groups of straight-chain aliphatic diols and polyols having 3 or more valences include, but are not limited to, residue groups derived from straight-chain aliphatic diols such as ethylene glycol, 1,3-propylene glycol, 1,4-butanediol, and 1,6-hexanediol.

As an alcohol component used for preparing the crystalline polyester (C), straight-chain unsaturated aliphatic dicarboxylic acids are preferably used compared to aromatic dicarboxylic acids because the straight-chain unsaturated aliphatic dicarboxylic acids can form crystalline structures much easier.

As a carboxylic acid component, a small amount of polycarboxylicacids can be used in combination with dicarboxylic acids. The polycarboxylic acids include, but are not limited to, (i) unsaturated aliphatic dicarboxylic acids having a branched-chain, (ii) saturated aliphatic polycarboxylic acids (such as saturated aliphatic dicarboxylic acids and saturated aliphatic tricarboxylic acids), and (iii) aromatic polycarboxylic acids (such as aromatic dicarboxylic acids and aromatic tricarboxylic acids).

The total carboxylic acid components typically include a polycarboxylic acid in an amount of not greater than 30% by mole, and preferably not greater than 10% by mole. Polycarboxylic acid can be added as appropriate unless the resultant polyester has crystallinity.

Specific examples of the polycarboxylic acids include, but are not limited to, dicarboxylic acids (e.g., malonic acid, succinic acid, glutaric acid, adipic acid, suberic acid, sebacic acid, citraconic acid, phthalic acid, isophthalic acid, terephthalic acid), polycarboxylic acids having 3 or more valences (e.g., trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, 1,2,7,8-octanetetracarboxylic acid), etc.

As an alcohol component, a small amount of aliphatic diols having a branched-chain, cyclic diols, and polyols having 3 or more valences can be used. The total alcohol components typically include the above alcohols in an amount of not greater than 30% by mole, and preferably not greater than 10% by mole. The above alcohols can be added as appropriate unless the resultant polyester has crystallinity.

Specific examples of the polyols include, but are not limited to, 1,4-bis(hydroxymethyl)cyclohexane, polyethylene glycol, ethylene oxide adduct of bisphenol A, propylene oxide adduct of bisphenol A, glycerin, etc.

The crystalline polyester (C) can be obtained by a typical polycondensation reaction between (i) a polycarboxylic acid including a straight-chain unsaturated aliphatic dicarboxylic acid or its derivatives (such as acid anhydride, lower alkyl ester having 1 to 4 carbon atoms, acid halide) and (ii) a polyol including a straight-chain aliphatic diol.

The polyester used for the toner of the present invention can be obtained by a dehydration condensation reaction or an interesterification reaction using the above-mentioned monomers in the presence of a catalyst. The reaction temperature is typically from 20 to 300° C., but is not particularly limited. The reaction time is typically from 30 minutes to 24 hours, but is not particularly limited.

Specific examples of the catalysts used for the reaction include, but are not limited to, zinc oxide, stannous oxide, dibutyl tin oxide, dibutyl tin dilaurate, etc. Various properties (e.g., softening point, melting point, glass transition temperature, amount of chloroform insoluble components) of the polyester resins (A), (B), and (C) can be easily controlled by changing reaction conditions and kinds and amounts of monomers, polymerization initiator, catalyst, etc. used in the reactions.

In the reactions for preparing the amorphous polyesters (A) and (B), and the crystalline polyester (C), inorganic tin (II) compounds or titanium containing compounds can be used as a catalyst.

The inorganic tin (II) compound is defined as a compound having no Sn-C bond. Specific examples of the inorganic tin (II) compounds include, but are not limited to, tin (II) compounds having a carboxylic acid group (e.g., tin (II) oxalate, tin (II) diacetate, tin (II) dioctanoate, tin (II) dilaurate, tin (II) distearate, tin (II) dioleate), tin (II) compounds having an alkoxygroup (e.g., tin (II) dioctyloxide, tin (II) dilauroxide, tin (II) distearoxide, tin (II) oleyloxide), tin (II) oxide, halogenated tin (II) (e.g., tin (II) chloride, tin (II) bromide), etc. Among these, tin (II) dioctanoate, tin (II) distearate, and tin (II) oxide are preferably used.

Titanium containing compounds can also be used as a catalyst. Specific examples of the titanium containing compounds include, but are not limited to, halogenated titaniums, titanium diketone enolates, titanium carboxylates, titanyl carboxylates, salts of titanyl carboxylates, etc.

Speceific examples of the halogenated titaniums include, but are not limited to, dichlorotitanium, trichlorotitanium, tetrachlorotitanium, trifluorotitanium, tetrafluorotitanium, tetrabromotitanium, etc.

Specific examples of the titanium diketone enolates include, but are not limited to, titanium acetylacetonate, titanium diisopropoxide bisacetylacetonate, titanyl acetylacetonate, etc. Among these, titanium acetylacetonate is preferably used.

Specific examples of the titanium carboxylates include, but are not limited to, titanium aliphatic carboxylates having 1 to 32 carbon atoms, titanium aromatic carboxylates having 7 to 38 carbon atoms, etc. In titanium polycarboxylates having 2 or more valences, 1 or more carboxyl group may coordinate with titanium atom, and free carboxyl group which does not coordinate with titanium atom may exist.

Specific examples of the titanium aliphatic carboxylates having 1 to 32 carbon atoms include, but are not limited to, titanium aliphatic monocarboxylates, titanium aliphatic dicarboxylates, titanium aliphatic tricarboxylates, titanium aliphatic polycarboxylates having 4 or more valences, etc.

Specific examples of the titanium aliphatic monocarboxylates include, but are not limited to, titanium formate, titanium acetate, titanium propionate, titanium octanoate, etc. Specific examples of the titanium aliphatic dicarboxylates include, but are not limited to, titaniumoxalate, titanium succinate, titanium maleate, titanium adipate, titanium sebacate, etc. Specific examples of the titanium aliphatic tricarboxylates include, but are not limited to, titanium octanetetracarboxylate, titanium decanetetracarboxylate, etc.

Specific examples of the titanium aromatic carboxylates having 7 to 38 carbon atoms include, but are not limited to, titanium aromatic monocarboxylates, titanium aromatic dicarboxylates, titanium aromatic tricarboxylates, titanium aromatic polycarboxylates having 4 or more valences, etc.

Specific examples of the titanium aromatic monocarboxylates include, but are not limited to, titanium benzoate, etc. Specific examples of the titanium aromatic dicarboxylates include titanium phthalate, titanium terephthalate, titanium isophthalate, titanium 1,3-naphthalenedicarboxylate, titanium 4,4-biphenyldicarboxylate, titanium2,5-toluenedicarboxylate, titanium anthracenedicarboxylate, etc. Specific examples of the titanium aromatic tricarboxylates include, but are not limited to, titanium trimellitate, titanium 2,4,6-naphthalenetricarboxylate, etc. Specific examples of the titanium aromatic polycarboxylates include, but are not limited to, titanium pyromellitate, titanium 2,3,4,6-naphthalenetetracarboxylate, etc.

Among these titanium carboxylates, titanium aromatic carboxylates having 7 to 38 carbon atoms are preferably used, and titanium aromatic dicarboxylates are more preferably used.

Specific examples of the titanyl carboxylates include, but are not limited to, titanyl aliphatic carboxylate having 1 to 32 carbon atoms, titanyl aromatic carboxylate having 7 to 38 carbon atoms, etc. In titanyl polycarboxylates having 2 or more valences, 1 or more carboxyl group may coordinate with titanium atom, and free carboxyl group which does not coordinate with titanium atom may exist.

Specific examples of the titanyl aliphatic carboxylates having 1 to 32 carbon atoms include, but are not limited to, titanyl aliphatic monocarboxylates, titanyl aliphatic dicarboxylates, titanyl aliphatic tricarboxylates, titanyl aliphatic polycarboxylates having 4 or more valences, etc.

Specific examples of the titanyl aliphatic monocarboxylates include, but are not limited to, titanyl formate, titanyl acetate, titanyl propionate, titanyl octanoate, etc. Specific examples of the titanyl aliphatic dicarboxylates include, but are not limited to, titanyl oxalate, titanyl succinate, titanyl maleate, titanyl adipate, titanyl sebacate, etc. Specific examples of the titanyl aliphatic tricarboxylates include, but are not limited to, titanyl octanetetracarboxylate, titanyl decanetetracarboxylate, etc.

Specific examples of the titanyl aromatic carboxylates having 7 to 38 carbon atoms include, but are not limited to, titanyl aromatic monocarboxylates, titanyl aromatic dicarboxylates, titanyl aromatic tricarboxylates, titanyl aromatic polycarboxylates having 4 or more valences, etc.

Specific examples of the titanyl aromatic monocarboxylates include, but are not limited to, titanyl benzoate, etc. Specific examples of the titanyl aromatic dicarboxylates include, but are not limited to, titanyl phthalate, titanyl terephthalate, titanyl isophthalate, titanyl 1,3-naphthalenedicarboxylate, titanyl 4,4-biphenyldicarboxylate, titanyl 2,5-toluenedicarboxylate, titanyl anthracenedicarboxylate, etc. Specific examples of the titanyl aromatic tricarboxylates include, but are not limited to, titanyl trimellitate, titanyl 2,4,6-naphthalenetricarboxylate, etc. Specific examples of the titanyl aromatic polycarboxylates include, but are not limited to, titanyl pyromellitate, titanyl 2,3,4,6-naphthalenetetracarboxylate, etc.

Specific examples of the salts of titanyl carboxylates include, but are not limited to, alkali metal (e.g., lithium, sodium, potassium) salts and alkaline earth metal (e.g., magnesium, calcium, barium) salts of the above-mentioned titanyl carboxylates (i.e., titanyl aliphatic dicarboxylate, titanyl aliphatic tricarboxylate, titanyl aliphatic polycarboxylate having 4 or more valences, titanyl aromatic dicarboxylate, titanyl aromatic tricarboxylate, and titanyl aromatic polycarboxylate having 4 or more valences). Among these, salts of titanyl maleate and salts of titanyl oxalate are preferably used.

The minimum amount of the titanium containing catalyst used for the reaction is preferably 0.01% by weight, more preferably 0.02% by weight, much more preferably 0.03% by weight, and most preferably 0.05% by weight, based on the total weight of polyols and polycarboxylic acids. The maximum amount of the titanium containing catalyst used for the reaction is preferably 5% by weight, more preferably 2% by weight, much more preferably 1.5% by weight, and most preferably 0.8% by weight, based on the total weight of polyols and polycarboxylic acids. The catalyst can sufficiently work when the added amount is within the above range. A toner including polyesters obtained by using such an amount of catalyst has good toner properties.

Among the above titanium containing catalysts, titanium diketone enolates, titanium carboxylates, salts of titanyl carboxylates, and mixtures thereof are preferably used; titanium diketone enolates, titanium aromatic carboxylates, salts of titanyl aliphatic carboxylates, salts of titanyl aromatic carboxylates, and mixtures thereof are more preferably used; titanium acetylacetonate, titanium aromatic dicarboxylates, alkali metal salts of titanyl carboxylates, and mixtures thereof are much more preferably used; titanium terephtalate, titanium isophthalate, titanium o-phthalate, salts of titanyl oxalate, salts of titanyl maleate, and mixtures thereof are even more preferably used; and titanium terephthalate, potassium titanyl oxalate, and mixtures thereof are most preferably used.

The crystalline polyester (C) preferably has a molecular weight distribution having a sharp peak, and a relatively low molecular weight, in terms of low temperature fixability. The crystalline polyester (C) preferably has a weight average molecular weight (Mw) of from 8,000 to 32,000, a number average molecular weight (Mn) of from 2,500 to 10,000, and their ratio (Mw/Mn) of from 1.5 to 6.0, when a molecular weight distribution of o-dichlorobenzene soluble components of the crystalline polyester (C) is determined by gel permeation chromatography (GPC).

Whether the crystalline polyester (C) has crystallinity is determined by subjecting the crystalline polyester (C) to a powder X-ray diffractometry under the following conditions.

Instrument used: RINT 1100 (from Rigaku Corporation)

X-ray tube: Cu

X-ray tube voltage: 50 kV

X-ray tube current: 30 mA

Goniometer: wide-angle goniometer

The crystalline polyester (C) used for the present invention has an X-ray diffraction spectrum such that at least one diffraction peak is observed in Bragg (2θ) angle ranges of from 20° to 25°, and preferably at least one diffraction peak is observed in each of Bragg (2θ) angle ranges of (i) 19° to 2020, (ii) 21° to 22°, (iii) 23° to 25°, and (iv) 29° to 31°.

It is preferable that the softening point (TmA) of the amorphous polyester (A) and the softening point (TmC) of the crystalline polyester (C) satisfy the following relationship (2):

$$TmC-40^\circ\ C. \leqq TmA \leqq TmC \quad (2)$$

When the relationship (2) is satisfied, the resultant toner has good low temperature fixability. In addition, the toner can be sharply melted. As a result, the toner is hardly melted at a temperature lower than a fixation starting temperature, and therefore the blocking problem is not caused. The toner is easily melted at a temperature higher than the fixation starting temperature, and therefore the toner can be strongly fixed on a recording material.

When TmA is higher than TmC, low temperature fixability of the toner deteriorates. When TmA is lower than (TmC−40° C.), the toner cannot be sharply melted at the fixation starting temperature because the difference between the softening point of the toner and the fixation starting temperature is large.

The crystalline polyester (C) preferably has a softening point TmC of from 80 to 140° C. TmC includes all values and subvalues therebetween, particularly including 90, 100, 110, 120, and 130° C. When TmC is too small, hot offset resistance and thermostable preservability of the toner are poor. When TmC is too large, low temperature fixability of the toner deteriorates.

In the toner of the present invention, it is preferable that the crystalline polyester (C) is incompatible with the amorphous polyesters (A) and (B). In other words, the crystalline polyester (C) forms its domain in the toner so that the crystalline polyester (C) is separate from the amorphous polyesters (A) and (B). When the crystalline polyester (C) is compatible with the amorphous polyesters (A) and (B), it means that no crystalline structure is remained therein. In this case, the crystalline polyester (C) and the amorphous polyesters (A) and (B) form a compatible domain, and each of the polyesters cannot exhibit its properties.

When the crystalline polyester (C) is incompatible with the amorphous polyesters (A) and (B), each of the polyesters can effectively exhibit its properties.

Whether the crystallinepolyester (C) is incompatible with the amorphous polyesters (A) and (B) in the toner can be determined by subjecting the toner to one of the following methods.

(1) Differential scanning calorimetry (DSC)

When at least an endothermic peak specific to the amorphous polyester (A) is observed in a temperature range of from 40 to 70° C., and an endothermic peak specific to the crystalline polyester (C) is observed in a temperature range of from 80 to 140° C., at a first temperature-rising scan of the DSC, it means that the crystalline polyester (C) is incompatible with the amorphous polyesters (A) and (B).

(2) X-ray diffractometry

When at least a diffraction peak specific to the crystalline polyester (C) is observed in Bragg (2θ) angle ranges of from 20° to 25°, it means that the crystalline polyester (C) is incompatible with the amorphous polyesters (A) and (B). When any diffraction peak specific to the crystalline polyester (C) is not observed, it means that the crystalline polyester (C) has no crystallinity and is compatible with the amorphous polyesters (A) and (B).

As mentioned above, the toner of the present invention at least comprises the two amorphouspolyesters (A) and (B) having different softening points, the crystalline polyester (C), and the fatty acid amide compound. The softening point (TmC) of the crystalline polyester (C) and the softening point (Tm (Asp)) of the fatty acid amide compound satisfy the following relationship:

$$TmC<Tm(Asp)$$

The fatty acid amide compound is preferably included in the domain of the crystalline polyester (C).

When the crystalline polyester (C) and the amorphous polyesters (A) and (B) are melt-kneaded, the crystallinity of the crystalline polyester (C) tends to be broken by application of heat, etc. As a result, the crystalline polyester (C) tends to become compatible with the amorphous polyesters (A) and (B). In this case, a glass transition temperature originating from the amorphous polyesters is decreased, and therefore thermostable preservability and low temperature fixability of the toner deteriorate.

As mentioned above, the toner of the present invention includes the fatty acid amide compound having a higher softening point than the crystalline polyester (C), wherein the fatty acid amide compound is included in the domain of the crystalline polyester (C). When the toner is melted by application of heat, the fatty acid amide compound serves as a seed of recrystallization of the crystalline polyester (C) and promotes the recrystallization thereof. As a result, the crystalline polyester (C) can be incompatible with the amorphous polyesters (A) and (B), even after the toner is melted. Thereby, each of the polyesters can effectively exhibit its properties. Such a toner has a good combination of low temperature fixability, hot offset resistance, and thermostable preservability.

The amorphous polyesters (A) and (B) having high softening points impart good thermostable preservability and hot offset resistance to the toner, and the crystalline polyester (C) imparts sharply melting property and low temperature fixability to the toner.

The fatty acid amide compounds for use in the present invention have the following formula:

$$R_1—CO—NR_2R_3$$

wherein $R_1$ represents an aliphatic hydrocarbon group having 1 to 30 carbon atoms; and each of $R_2$ and $R_3$ independently represents a hydrogen atom, an alkyl group having 1 to 10 carbon atoms, an aryl group having 6 to 10 carbon atoms, or an aralkyl group having 7 to 10 carbon atoms. The alkyl group, the aryl group, and the aralkyl group may have an inert substituent such as fluorine atom, chlorine atom, cyano group, alkoxy group, and alkylthio group. However, it is preferable that the above groups have no substituent.

Specific examples of the fatty acid amide compounds include stearic acid amide, stearic acid methylamide, stearic acid diethylamide, stearic acid benzylamide, stearic acid phenylamide, behenic acid amide, behenic acid dimethylamide, myristic acid amide, palmitic acid amide, etc.

In the present invention, alkylenebis fatty acid amides are most preferably used. The alkylenebis fatty acid amides have the following formula (II):

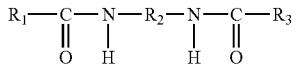

(II)

wherein each of $R_1$ and $R_3$ independently represents an alkyl group or an alkenyl group, having 5 to 21 carbon atoms; and $R_2$ represents an alkylene group having 1 to 20 carbon atoms.

Specific examples of the alkylenebis fatty acid amides having the formula (II) include, but are not limited to, methylenebis stearic acid amide, ethylenebis stearic acid amide, methylenebis palmitic acid amide, ethylenebis palmitic acid amide, methylene bisbehenic acid amide, ethylenebis behenic acid amide, hexamethylenebis stearic acid amide, hexaethylenebis palmitic acid amide, hexamethylenebis behenic acid amide, etc. Among these, ethylenebis stearic acid amide is most preferably used.

Other examples of the alkylenebis fatty acid amide compounds include, but are not limited to, alkylenebis fatty acid amide compounds of saturated fatty acid amides and unsaturated monovalent and divalent fatty acid amides (e.g., propylenebis stearic acid amide, butylenebis stearic acid amide, methylenebis oleic acid amide, ethylenebis oleic acid amide, propylenebis oleic acid amide, butylenebis oleic acid amide, methylenebis lauric acid amide, ethylenebis lauric acid amide, propylenebis lauric acid amide, butylenebis lauric acid amide, methylenebis myristic acid amide, ethylenebis myristic acid amide, propylenebis myristic acid amide, butylenebis myristic acid amide, propylenebis palmitic acid amide, butylenebis palmitic acid amide, methylenebis palmitoleic acid amide, ethylenebis palmitoleic acid amide, propylenebis palmitoleic acid amide, butylenebis palmitoleic acid amide, methylenebis arachidic acid amide, ethylenebis arachidic acid amide, propylenebis arachidic acid amide, butylenebis arachidic acid amide, methylenebis eicosenoic acid amide, ethylenebis eicosenoic acid amide, propylenebis eicosenoic acid amide, butylenebis eicosenoic acid amide, methylenebis behenic acid amide, ethylenebis behenic acid amide, propylenebis behenic acid amide, butylenebis behenic acid amide, methylenebis erucic acid amide, ethylenebis erucic acid amide, propylenebis erucic acid amide, butylenebis erucic acid amide).

The softening point (Tm(Asp)) of the fatty acid amide compound and a surface temperature ($T_H$) of a fixing member satisfy the following relationship:

$$Tm(Asp)<T_H$$

In this case, when the toner is going to be fixed on a recording material, the fatty acid amide compound exudes from the toner due to heat applied by the fixing member. In other words, when Tm(Asp) is lower than $T_H$, the fatty acid amide compound can act like a release agent on the surface of the fixing member.

In addition, since Tm(Asp) is higher than TmC, the fatty acid amide compound can serve as a seed of recrystallization of the melted crystalline polyester resin (C) when the toner constituents are melt-kneaded.

In the present invention, $T_H$ is defined as an average surface temperature of a fixing member of 1 minute, wherein the surface temperature of the fixing member is measured after a paper having basic weight of 90 kg (from Ricoh Company Ltd.) is continuously sent for 10 minutes in an image forming apparatus.

Next, other materials for use in the toner of the present invention will be explained in detail.

Binder Resin

Any known resins can be used in the toner of the present invention other than the above-mentioned polyester resins. Specific examples of other binder resins include, but are not limited to, styrene resins (e.g., styrene, α-methylstyrene, chlorostyrene, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-acrylonitrile-acrylate copolymer), polyester resins, vinyl chloride resins, rosin-modified maleic acid resins, phenol resins, epoxy resins, polyethylene resins, polypropylene resins, ionomer resins, polyurethane resins, silicone resins, ketone resins, xylene resins, petroleum resins, hydrogenated petroleum resins, etc. Among these, styrene resins and polyester resins having aromatic components are preferably used.

Colorant

Specific examples of the colorants for use in the present invention include, but are not limited to, any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner preferably includes a colorant in an amount of from 1 to 15% by weight, and more preferably from 3 to 10% by weight.

The colorant for use in the present invention can be combined with a resin to be used as a master batch. Specific examples of the resin for use in the master batch pigment or for use in combination with master batch pigment include, but are not limited to, styrene polymers and substituted styrene polymers such as polystyrene, poly-p-chlorostyrene and polyvinyltoluene; styrene-vinyl copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, etc. These resins are used alone or in combination.

Charge Controlling Agent

The toner of the present invention may optionally include a charge controlling agent. Specific examples of the charge controlling agents include, but are not limited to, any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.;

TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

Release Agent

The toner of the present invention preferably includes at least one wax having a melting point of from 50 to 120° C. Such a low melting point wax can exude from binder resins and effectively work as a release agent between a fixing member and the toner. The fixing member has no need to be applied a fixing oil. Specific examples of the release agents include, but are not limited to, natural waxes such as plant waxes (e.g., carnauba wax, cotton wax, haze wax, rice wax), animal waxes (e.g., bees wax, lanoline), mineral waxes (e.g., ozokerite, ceresin), and petroleum waxes (e.g., paraffin, microcrystalline, petrolatum); synthetic hydrocarbon waxes such as Fischer-Tropsch wax and polyethylene wax; synthetic waxes such as esters, ketones, and ethers; fatty acid amides such as 12-hydroxystearic acid amide, stearic amide, phthalic anhydride imide, halogenated hydrocarbon; crystalline polymers having a side-chain long alkyl group such as homopolymers or copolymers of polyacrylates such as poly-n-stearyl methacrylate and poly-n-lauryl methacrylate (e.g., copolymer of n-stearyl acrylate and ethyl methacrylate); etc.

The charge controlling agent and the release agent can be melt-kneaded together with the master batch and the binder resin. Of course, these can be dissolved or dispersed inorganic solvents (when the toner is a polymerization toner).

The toner of the present invention is preferably a pulverization toner obtained by a method such as a kneading-pulverization method. For example, after mixing toner constituents (such as a binder resin and a colorant) by a mixer (such as a ball mill), the mixture is melt-kneaded with a kneader (such as hermetically closed kneader, single-axis extruder, double-axis extruder), followed by cooling, pulverization, and classification. The toner may be obtained by a polymerization method.

The surface of the toner can be optionally treated with an agent such as fluidity improving agents. In this case, the agents can be mixed with the toner using a mixer such as SUPER MIXER and HENSCHEL MIXER.

Viscoelasticity

The amorphous polyester (B) preferably has a viscoelastic property such that a ratio (G'100/G'150) between a storage elastic modulus (G'100) at 100° C. and a storage elastic modulus (G'150) at 150° C. is from 3.0 to 30.0. The ratio (G'100/G'150) includes all values and subvalues therebetween, particularly including 5.0, 10.0, 15.0, 20.0, and 25.0.

A storage elastic modulus represents an elasticity of a material. When the ratio (G'100/G'150) is within the above range, the elasticity of the amorphous polyester (B) does not largely vary even in the high temperature range, i.e., the toner has a stable fixability in a high temperature range.

The storage elastic modulus G' is measured using a rheometer RHEOSTRESS RS50 (from HAAKE) under the following conditions.

Sweeping method: temperature sweeping
Frequency: 1 Hz (6.28 rad/s)
Temperature: 80 to 210° C.
Strain: 0.1 (strain control)
Temperature rising speed: 2.5° C./min A sample is pelletized into a pellete having a diameter of 20 mm and a thickness of 2.00 mm, and set to a pair of parallel plate having a diameter of 20 mm.

Glass Transition Temperature

The toner of the present invention preferably has a glass transition temperature (Tg) of from 35 to 70° C. The Tg includes all values and subvalues therebetween, particularly including 40, 45, 50, 55, 60, and 65° C. When the Tg is too small, hot offset resistance and thermostable preservability deteriorate. When the Tg is too large, low temperature fixability deteriorates.

The Tg is measured using a TG-DSC system TAS-1000 (from Rigaku Corporation). About 10 mg of a sample is fed into an aluminum sample container, and then the aluminum sample container is set in an electric furnace.

The sample is heated from room temperature to 150° C. at a temperature rising speed of 10° C./min, and after 10 minutes left at 150° C., the sample is cooled to room temperature. Next, the sample is heated again to 150° C. at a temperature rising speed of 10° C./min under nitrogen gas atmosphere. Thus, an endothermic curve is obtained.

Tg is determined by finding an intersection point of a tangent line of the endothermic curve near Tg and a baseline, using an analysis system of the TAS-1000.

Average Circularity

The toner of the present invention preferably has an average circularity of from 0.85 to 0.95.

The circularity of a particle is determined by the following equation:

$$C=Lo/L$$

wherein C represents the circularity, Lo represents the length of the circumference of a circle having the same area as that of the image of the particle and L represents the peripheral length of the image of the particle. The circularity indicates the irregularity of the toner particle. When the toner is completely spherical, C is 1.00. When the toner shape becomes more complex, the circularity decreases.

A toner having high circularity is easily influenced by a development electric field, and therefore such a toner can faithfully develop an electrostatic latent image. In other words, such a toner can produce high definition images at an appropriate image density.

When the average circularity is too large, the toner cannot sufficiently contact a cleaning member due to its high circularity, resulting in deterioration of cleanability. When the average circularity is too small, transferability of the toner deteriorates and toner scattering tends to be caused.

The average circularity of a toner can be determined using a flow-type particle image analyzer FPIA-2100 manufactured by Sysmex Corp and an analysis software FPIA-2100 Data Processing Program for FPIA version 00-10.

Specifically, the method is as follows:

(1) 0.1 g to 0.5 g of a sample to be measured is mixed with 80 ml of ion-exchange water which includes 0.1 ml to 0.5 ml of a 10% by weight of aqueous solution of a dispersant (i.e., a surfactant) such as an alkylbenzene sulfonic acid salt NEOGEN SC-A from Dai-ichi Kogyo Seiyaku Co., Ltd;

(2) the mixture is dispersed using an ultrasonic dispersing machine (W-113MK-II from Honda Electronics Co., Ltd.) for 3 minutes to prepare a suspension including particles of 5,000 to 15,000 per micro-liter of the suspension; and (3) the average circularity and circularity distribution of the sample in the suspension are determined by the measuring instrument mentioned above.

It is important that the suspension includes toner particles of from 5,000 to 15,000 per micro-liter. This toner particle concentration can be controlled by changing the amount of the dispersant and the toner included in the suspension. The needed amount of the dispersant depends on hydrophobicity of the toner. When the amount of the dispersant is too large, bubbles are formed in the suspension, resulting in background noise of the measurement. When the amount of the dispersant is too small, toner particles cannot sufficiently get wet, resulting in deterioration of dispersibility. On the other hand, the needed amount of the toner depends on the particle diameter thereof. As the particle diameter decreases, the needed amount of the toner decreases. When the toner has a particle diameter of from 3 to 7 μm, it is preferable to add from 0.1 to 0.5 g of the toner so as to prepare a suspension including toner particles of 5,000 to 15,000 per micro-liter of the suspension.

Particle Diameter

The toner of the present invention preferably has a weight average particle diameter (Dv) of from 3 to 13 μm. When the Dv is too small, the toner tends to fuse on the surface of the carrier by a long-term agitation in a developing device, resulting in deterioration of chargeability of a carrier, when the toner is used for a two-component developer. When the toner is used for a one-component developer, problems such that the toner forms a film on a developing roller, and the toner fuses on a toner layer forming member tend to be caused. In contrast, when the Dv is too large, it is difficult to obtain high definition and high quality images. In addition, an average particle diameter of a toner included in a developer tends to be largely changed when a part of toner particles are replaced with fresh toner particles.

In addition, the toner of the present invention preferably has a ratio (Dv/Dn) between the weight average particle diameter (Dv) and the number average particle diameter of from 1.00 to 1.40, and more preferably from 1.00 to 1.25. Such a toner can produce high definition and high quality images. In order to produce images having much higher quality, the toner preferably has a weight average particle diameter (Dv) of from 3 to 11 μm and a ratio (Dv/Dn) of from 1.00 to 1.20, and includes particles having a particle diameter of not greater than 3 μm in an amount of from 1 to 10% by number; and more preferably the toner has a weight average particle diameter (Dv) of from 3 to 10 μm and a ratio (Dv/Dn) of from 1.00 to 1.15. When such a toner is used for a two-component developer, an average particle diameter of the toner included in a developer hardly changes when a part of the toner particles are replaced with fresh toner particles, and therefore the toner provides stable developability for a long period of time.

The volume average particle diameter (Dv), the number average particle diameter (Dn) and a particle diameter distribution of a toner can be measured using an instrument COULTER COUNTER TA-II or COULTER MULTISIZER II (from Coulter Electrons Inc.). An interface (from The Institute of JUSE) outputting number distribution and volume distribution, and a personal computer PC9801 (from NEC Corporation) are connected to the above instrument.

The measuring method is as follows:

(1) 0.1 to 5 ml of a surfactant (preferably alkylbenzene sulfonate) is included as a dispersant in 100 to 150 ml of the electrolyte (i.e., 1% NaCl aqueous solution including a first grade sodium chloride such as ISOTON-II from coulter Electrons Inc.);

(2) 2 to 20 mg of a toner is added in the electrolyte and the toner is dispersed by an ultrasonic dispersing machine for about 1 to 3 minutes to prepare a toner dispersion liquid;

(3) a volume and a number of the toner particles is measured by COULTER COUNTER TA-II or COULETR MULTISIZER II using an aperture of 100 μm to determine volume and number distribution thereof; and (4) the volume average particle diameter (Dv) and the weight average particle diameter (Dn) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, the particles having a particle diameter of from not less than 2.00 μm and to less than 40.30 μm can be measured.

Shape Factors

The toner of the present invention preferably has a shape factor SF-1 of from 100 to 180 and another shape factor SF-2 of from 100 to 180. It is more preferable that the toner has a SF-1 of from 110 to 170, much more preferable from 120 to 160, and most preferable from 130 to 150. It is more preferable that the toner has a SF-2 of from 110 to 170, much more preferable from 120 to 160, and most preferable from 130 to 150.

The shape factor SF-1 represents the degree of the roundness of a toner particle, and is defined by the following equation (3):

$$SF\text{-}1=\{(MXLNG)^2/(\text{AREA})\}\times(100\pi/4) \quad (3)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. When the SF-1 is larger than 100, the toner particles have irregular forms.

The shape factor SF-2 represents the degree of the concavity and convexity of a toner particle, and is defined by the following equation (4):

$$SF\text{-}2=\{(PERI)^2/(\text{AREA})\}\times(100/4\pi) \quad (4)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity) When the SF-2 is large, the toner particles are roughened.

The shape factor SF-1 is determined by the following method:

(1) particles of a toner are photographed using a scanning electron microscope (FE-SEM S-800, manufactured by Hitachi Ltd.) at a magnification of 500 times; and (2) 100 randomly selected toner particles of photograph images are analyzed using an image analyzer (such as NEXUS NEW CUBE ver. 2.5 manufactured by NEXUS Co., Ltd. and LUZEX 3 manufactured by Nireco Corp.) via an interface to determine the SF-1.

The shape factor SF-2 is determined by the following method:

(1) particles of a toner are photographed using a scanning electron microscope (FE-SEM S-800, manufactured by Hitachi Ltd.) at a magnification of 3500 times; and (2) 50 randomly selected toner particles of photograph images are analyzed using an image analyzer (such as NEXUS NEW CUBE ver. 2.5 manufactured by NEXUS Co., Ltd. and LUZEX 3 manufactured by Nireco Corp.) via an interface to determine the SF-2.

When the toner particles have spherical form, the toner particles contact the other toner particles and the photoreceptor at one point. Therefore, the adhesion of the toner particles to the other toner particles and the photoreceptor decreases, resulting in increase of the fluidity of the toner particles and the transferability of the toner. In addition, dot reproducibility also improves. In contrast, when the SF-1 and SF-2 are large, the toner particles have irregular forms and therefore cleanability improves. The toner of the present invention preferably has shape factors SF-1 and SF-2 of from 100 to 180, respectively, in order to keep good balance between transferability and cleanability.

Two-component Developer

The toner of the present invention can be used for a two-component developer by mixing with a magnetic carrier. The two-component developer preferably includes the toner in an amount of from 0.5 to 1.0 parts by weight, based on 100 parts of a carrier. Any known magnetic oxides can be used as a carrier. For example, iron powder, ferrite powder, magnetite powder, and magnetic resin carrier, having particle diameter of from 50 to 125 μm, can be used. In particular, ferrites and magnetites having grain boundary and holes on the surface thereof, and mixtures thereof are preferably used. Specific preferred examples of suitable ferrites include, but are not limited to, Ni-Zn ferrite, Cu-Zn ferrite, Mn ferrite, Mg ferrite, and Mn-Mg ferrite.

Specific examples of resins for use in the cover layer of the carrier include, but are not limited to, amino resins (e.g., urea-formaldehyde resins, melamine resins, benzoguanamine resins, urea resins, polyamide resins, epoxy resins), polyvinyl and polyvinylidene resins (e.g., acrylic resins, polymethyl methacrylate, polyacrylonitrile, polyvinyl acetate, polyvinyl alcohol, polyvinyl butyral), polystyrene resins (e.g., polystyrene, styrene-acrylic copolymer), halogenated olefin resins (e.g., polyvinyl chloride), polyester resins (e.g., polyethylene terephthalate, polybutylene terephthalate), polycarbonate resins, polyethylene, polyvinyl fluoride, polyvinylidene fluoride, polytrifluoroethylene, polyhexafluoropropylene, copolymer of vinylidene fluoride and acrylic monomer, copolymer of vinylidene fluoride and vinyl fluoride, fluoroterpolymers (e.g., terpolymer of tetrafluoroethylene and vinylidene fluoride and non-fluoride monomer), silicone resins, etc.

The resins for use in the cover layer of the carrier optionally include conductive particulate materials. Specific examples of the conductive materials include, but are not limited to, metal powders, carbon blacks, titanium oxides, tin oxides, zincoxides, etc. Specific examples of the carbon blacks include, but are not limited to, furnace black, acetylene black, thermal black, etc. The conductive particulate material preferably has an average particle diameter of not greater than 1 μm. When the average particle diameter is too small, it is difficult to control the electrical resistance of the carrier.

The toner of the present invention can be used as a one-component developer by including a magnetic material. Specific examples of the magnetic materials include, but are not limited to, iron oxides (e.g., magnetites, hematites, ferrites), metals (e.g., iron, cobalt, nickel) and alloys of these metals with aluminum, cobalt, copper, lead, magnesium, tin, zinc, antimony, beryllium, bismuth, cadmium, calcium, manganese, selenium, titanium, tungsten, vanadium, etc. These can be used alone or in combination.

Image Forming Apparatus

FIGURE is a schematic view illustrating an embodiment of the image forming apparatus (laser beam printer) of the present invention.

On the upper right side of an image forming apparatus 1, a photoreceptor 3 serving as an image bearing member is arranged. Around the photoreceptor 3, a charging device 4, a developing device 8, and a cleaning device 20 are arranged. On the upper side of the photoreceptor 3, a light irradiator 30 configured to form a latent image on the photoreceptor 3 by emitting a laser light based on image information. The light irradiator 30 includes a rotatable polygon mirror 5 and a light source 6 configured to emit a laser beam to the rotatable polygon mirror 5. The light source 6 is arranged on the right side of the rotatable polygon mirror 5. The light source 6 includes a semiconductor laser, a light-emitting diode, etc. An fθ lens 7 configured to transmit a light reflected by the rotatable polygon mirror 5 is arranged between the rotatable polygon mirror 5 and the light source 6.

A transfer device 12 configured to transfer a toner image onto a transfer material is arranged between the developing device 8 and the cleaning device 20. On the left side of the transfer device 12, a fixing device 2 configured to fix the toner image onto the transfer material is arranged.

The fixing device 2 includes a heat roller 14 containing a heater lamp therein and a press roller 15 facing the heat roller 14. The heat roller 14 and the press roller 15 form a fixing roller 21.

On the lower side of the image forming apparatus 1, a paper hopper 9 configured to store a transfer material 10 serving as a fixing medium is arranged. On the upper side of the paper hopper 9, a paper feed tractor 11 configured to feed the transfer material 10 stored in the paper hopper 9. A buffer plate 24 configured to absorb slacks or tensions of the transfer material 10 is arranged between the paper feed tractor 11 and the fixing device 2.

The developing device 8 includes a developing unit 81 and a toner supplying room 82 configured to supply a toner to the developing unit 81. The developing unit 81 includes a developing bearing member **8*a* configured to bear a developer and supply the developer to the photoreceptor 3, and a developer controlling member configured to control the amount of the developer supplied to the photoreceptor 3**.

The developer bearing member **8*a* consists of an electrically conductive non-magnetic cylindrical material. The developer bearing member 8*a* is rotatively supported on the developing device 8 and faces the photoreceptor 3 at a small distance. The developer bearing member 8*a* contains a magnetic roll coaxially arranged therein. The developer contained in the toner supplying room 82 is magnetically attracted to the surface of the developer bearing member 8***a* due to a magnetic force of the magnetic roll, and fed to a developing region. The developer bearing member 8*a* is connected to an electric source (not shown). When a voltage is applied from the electric source to the developer bearing member 8*a*, an electric field is formed between the developer bearing member 8*a* and the photoreceptor 3 in the developing region.

Next, an operation of the image forming apparatus 1 will be explained.

Once a start signal for printing operation is transmitted from a controller (not shown), the photoreceptor 3 starts to rotate in the direction indicated by an arrow A. The photoreceptor 3 rotates at a speed corresponding to a printing speed of the image forming apparatus 1, and continues to rotate until the printing operation is finished.

When the photoreceptor 3 starts to rotate, a high voltage is applied to a corona charger included in the charging device 4. The corona charger provides a charge (e.g., positive charge) to the surface of the photoreceptor 3 so that the surface of the photoreceptor 3 is uniformly charged.

The rotatable polygon mirror 5 starts to rotate immediately after the power is applied to the image forming apparatus 1. The rotatable polygon mirror 5 faithfully keeps to rotate at a predetermined speed while the power is applied, and reflects a laser beam emitted by the light source 6 to the fθ lens 7. The laser beam passed through the fθ lens 7 irradiates the photoreceptor 3 while scanning thereon.

After converting character data and graphic data of an original document into a dot image, the dot image is converted into an on/off signal of a laser beam and transmitted to the image forming apparatus 1.

The charging device 4 and the light irradiator 30 form a irradiated portion and a non-irradiated portion by the laser beam on the surface of the photoreceptor 3 based on the signal information, resulting in formation of an electrostatic latent image.

On the other hand, the developer bearing member 8*a* attracts a toner contained in the developing unit 81 due to a magnetic force of the magnetic roll and feeds the toner to the developing region while rotating at a predetermined speed.

When the electrostatic latent image formed on the surface of the photoreceptor 3 comes to the developing region at which the photoreceptor faces the developing unit 8, the toner is supplied to the electrostatic latent image due to the act of an electric field formed by an application of a voltage from the electric source. (For example, a positively charged toner is electrically attracted to a portion of the electrostatic latent image at which the charge is disappeared by the laser beam emission.) Thus, a toner image is formed on the surface of the photoreceptor 3.

The image forming apparatus 1 uses a two-component developer including a carrier and the above-mentioned toner in the developing device 8. The carrier for use in the developing device 8 preferably has a volume average particle diameter (Dvc) of from 50 to 125 μm. Dvc includes all values and subvalues therebetween, particularly including 55, 60, 65, 70, 75, 80, 85, 90, 95, 100, 105, 110, 115, and 120 μm. When Dvc is too small, magnetism per particle of the carrier is too small, and therefore carrier adherence tends to occur. In contrast, when Dvc is too large, magnetic brushes formed on the developer bearing member 8*a* is too thick, and therefore reproducibility of sharp images deteriorates. In addition, specific surface of the carrier is too small, and therefore a toner cannot be sufficiently charged and abnormal images caused by insufficient charging (such as background fouling) tend to be produced.

The carrier for use in the developing device 8 preferably has a particle diameter distribution property such that the carrier includes carrier particles having a particle diameter of less than 0.4 times the Dvc in an amount of not greater than 0.1% by weight, and preferably includes carrier particles having a particle diameter of not less than 0.4 times and less than 0.6 times the Dvc in an amount of not greater than 4.0% by weight.

When the carrier does not have the above particle diameter distribution property, carrier particles having significantly weak magnetism exist on the developer bearing member, and occurrence of carrier adherence cannot be prevented even if the carrier has the above volume average particle diameter. When the carrier has the above particle diameter distribution property, occurrence of carrier adherence can be prevented.

The volume average particle diameter (Dvc) of the carrier can be measured using an instrument MICROTRAC SRA (manufactured by Nikkiso Co., Ltd.). The measurement conditions are as follows.

Measurement range: 0.7 μm to 125 μm
Dispersion liquid: methanol
Refractive index of methanol: 1.33
Refractive index of carrier and core material: 2.42

When a linear speed (Va) of the developer bearing member 8*a* is greater than 650 mm/sec, the magnetic brushes formed on the developer bearing member 8*a* have a large impact on the photoreceptor 3, and therefore the carrier tends to release from the magnetic brushes. In this case, carrier adherence is much more easily occurred compared to a case when the linear speed (Va) is small. If carrier adherence is occurred on the photoreceptor 3, abnormal images tend to be produced. In addition, the photoreceptor 3 is abraded, resulting in deterioration of durability of the photoreceptor 3.

The image forming apparatus of the present invention can produce high quality images by using the above-mentioned carrier even if the linear speed (Va) of the developer bearing member is greater than 650 mm/sec.

As mentioned above, in the toner of the present invention, the crystalline polyester (C) is incompatible with the amorphous polyesters. When the toner is heated by the fixing roller 21 at a fixing nip, the toner is immediately fixed on the transfer material 10 due to a sharply melting property of the crystalline polyester (C). In addition, the fatty acid amide compound and other release agent included in the toner rapidly exude from the toner. Thereby, the fixed image is quickly released from the heat roller 14.

For this reason, the toner has good fixability and hot offset resistance even if a linear speed of the fixing roller increases as the linear speed (Va) of the developer bearing member 8*a* increases. In other words, well-fixed high quality images can be produced even if an image forming speed is high.

The linear speed (Va) of the developer bearing member 8*a* is measured using an instrument RP704Z/FG-1200 (manufactured by Ono Sokki Co., Ltd.). The instrument directly contacts the developer bearing member 8*a* at a portion closest to the photoreceptor 3 to measure the linear speed thereof.

When the toner image formed on the photoreceptor 3 comes to a transfer region T formed between the photoreceptor 3 and the transfer device 12, the paper feed tractor 11 timely feeds the transfer paper 10 contained in the paper hopper 9 to the transfer region T to meet the toner image.

The transfer device 12 applies a reverse charge of the toner charge to the reverse side of the transfer material 10 fed to the transfer region T. The toner image formed on the photoreceptor 3 is attracted onto the transfer material 10, resulting in transferring the toner image onto the transfer material 10. The cleaning device 20 removes residual toner particles and other extraneous materials remaining on the photoreceptor 3 after passing through the transfer region T to prepare for the next image forming operation.

The paper feed tractor 11 feeds the transfer material 10 passed thorough the transfer region T to the fixing device 2 via the buffer plate 24. The buffer plate 24 absorbs slacks and tensions of the transfer material 10 caused by a speed difference between the paper feed tractor 11 and the fixing roller 21.

After pre-heating the transfer material 10 by a pre-heating plate 13, the fixing device 2 fixes the toner image transferred on the transfer material 10 by application of heat and pressure at a nip formed between the heat roller 14 and the press roller 15 while feeding the transfer material 10.

A paper discharging roller 16 discharges the transfer material 10 discharged from the heat roller 14 and the press roller 15, to a scattering table 19.

The transfer material 10 discharged to the scattering table 19 is alternately folded along its perforation by oscillation of a swing fin 17. The folded transfer material 10 is aligned by rotation of a paddle 18 and stacked on the scatter table 19.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Amorphous Polyesters (A1) and (A2) Amorphous polyesters (A1) and (A2) are respectively prepared as follows.

Monomers described in Table 1 and 0.1% by weight of a hydroquinone (based on the total weight of the monomers) are fed in a four-necked round-bottom 5L flask equipped with a thermometer, a stirrer, a condenser, and a nitrogen gas feed pipe. The flask is set in a mantle heater, and nitrogen gas is introduced to the flask from the nitrogen gas feed pipe to fill the flask with an inert atmosphere. The flask is heated to 160° C. and subjected to a reaction for 5 hours, and then heated to 200° C. and subjected to a reaction for 1 hour, followed by 1-hour reaction under a pressure of 8.3 kPa. Thus, amorphous polyesters (A1) and (A2) are respectively prepared.

The monomer compositions and softening points of the amorphous polyester (A1) and (A2) are shown in Table 1.

TABLE 1

| Amorphous Polyester | Monomers | Number of moles | Tm (° C.) |
|---|---|---|---|
| A1 | Polyoxypropylene(2,2)-2,2-bis(4-hydroxyphenyl) propane | 1 | 115 |
| | Polyoxyethylene(2,2)-2,2-bis(4-hydroxyphenyl) propane | 3 | |
| | Fumaric acid | 3.9 | |
| | Terephthalic acid | 0.2 | |
| A2 | Polyoxypropylene(2,2)-2,2-bis(4-hydroxyphenyl) propane | 1 | 146 |
| | Polyoxyethylene(2,2)-2,2-bis(4-hydroxyphenyl) propane | 3 | |
| | Succinic acid | 0.5 | |
| | Terephthalic acid | 3.9 | |

Preparation of Amorphous Polyesters (B1) and (B2)

Amorphous polyesters (B1) and (B2) are respectively prepared as follows.

Monomers described in Table 2 and 0.1% by weight of a hydroquinone (based on the total weight of the monomers) are fed in a four-necked round-bottom 5L flask equipped with a thermometer, a stirrer, a condenser, and a nitrogen gas feed pipe. The flask is set in a mantle heater, and nitrogen gas is introduced to the flask from the nitrogen gas feed pipe to fill the flask with an inert atmosphere. The flask is heated to 160° C. and subjected to a reaction for 5 hours, and then heated to 200° C. and subjected to a reaction for 1 hour, followed by 1-hour reaction under a pressure of 8.3 kPa. Thus, amorphous polyesters (B1) and (B2) are respectively prepared.

The monomer compositions and softening points of the amorphous polyester (B1) and (B2) are shown in Table 2.

TABLE 2

| Amorphous Polyester | Monomers | Number of moles | Tm (° C.) |
|---|---|---|---|
| B1 | Polyoxypropylene (2, 2)-2,2-bis(4-hydroxyphenyl) propane | 1 | 146.5 |
| | Polyoxyethylene(2, 2)-2,2-bis(4-hydroxyphenyl) propane | 3 | |
| | Terephthalic acid | 1.2 | |
| | Fumaric acid | 3.0 | |
| B2 | Polyoxypropylene(2, 2)-2,2-bis (4-hydroxyphenyl) propane | 1 | 208 |
| | Polyoxyethylene(2,2)-2,2-bis(4-hydroxyphenyl) propane | 3 | |
| | Terephthalic acid | 0.4 | |
| | 1, 2, 4-Benzenetricarboxylic acid | 3.0 | |

Preparation of Crystalline Polyesters (C1) to (C3)

Crystalline polyesters (C1), (C2), and (C3) are respectively prepared as follows.

Monomers described in Table 3 and a proper amount of an organic tin compound or an inorganic tin compound (as a catalyst) are fed in a four-necked round-bottom 5L flask equipped with a thermometer, a stirrer, a condenser, and a nitrogen gas feed pipe. The flask is heated to 200° C. and subjected to dehydration condensation reaction for 10 hours while removing produced water. The monomers are further reacted under a pressure of 8.0 kPa until the product had a desired softening point. Thus, crystalline polyesters (C1), (C2), and (C3) are respectively prepared.

The monomer compositions and softening points of the crystalline polyesters (C1), (C2), and (C3) are shown in Table 3.

TABLE 3

| Crystalline Polyester | Monomers | Number of moles | Tm (° C.) |
|---|---|---|---|
| C1 | 1,6-Hexanediol | 0.8 | 117 |
| | 1,8-Octanediol | 0.2 | |
| | Succinic acid | 1.0 | |
| C2 | 1,6-Hexanediol | 0.8 | 120 |
| | 1,8-Octanediol | 0.2 | |
| | Succinic acid | 1.0 | |
| | Hydrophobic silica | 1% by weight based on monomers | |
| C3 | 1,4-Butanediol | 3.0 | 152 |
| | Terephthalic acid | 1.5 | |
| | Isophthalic acid | 1.0 | |

The softening points of the polyesters are measured by a method based on JIS K2207 (ring and ball method).

Example 1

The following components are mixed using a HENSCHEL MIXER.

| | |
|---|---|
| Amorphous polyester (A1) | 55 parts |
| Amorphous polyester (D1) | 20 parts |
| Crystalline polyester (C1) | 25 parts |
| Carbon black (MOGUL L from Cabot Corporation) | 10 parts |
| Charge controlling agent (BONTRON N-04 from Orient Chemical Industries, Ltd.) | 2 parts |
| Carnauba wax (CARNAUBA WAX C1 from S. Kato & Co., melting point of 84 °C.) | 3 parts |
| Fatty acid amide (KAOWAX EB-FF from Kao Corporation, melting point of from 141.5 to 146.5 °C.) | 5 parts |

The mixture is melt-kneaded using a double-axis extruder under the following conditions.

Rotation speed: 200 rpm

Heating temperature: 100° C.

Feeding speed: 15 kg/h

The kneaded mixture is rolled (i.e., extended by application of pressure) by a roller, and then subjected to cooling. Next, the mixture is subjected to coarse pulverization and fine pulverization using a TURBO-MILL, followed by classification. Thus, mother toner particles having a volume average particle diameter of 10.0 μm are prepared.

Next, 100 parts of the mother toner particles are mixed with 1.0 part of a hydrophobic silica TG820 (from Cabot Corporation) using a HENSCHEL MIXER. Thus, a toner (1) is prepared.

Example 2

The procedure for preparation of the toner (1) is repeated except the carnauba wax is replaced with a polyethylene wax (LEL800 from Sanyo Chemical Industries, Ltd., melting point of 133° C.). Thus, a toner (2) is prepared.

Example 3

The procedure for preparation of the toner (1) is repeated except "3 parts of the carnauba wax" is replaced with "2 parts of the carnauba wax and 2 parts of the polyethylene wax". Thus, a toner (3) is prepared.

Example 4

The procedure for preparation of the toner (1) is repeated except the amount of the amorphous polyester (A1) is changed from 55 parts to 65 parts, and the amount of the crystalline polyester (C1) is changed from 25 parts to 10 parts. Thus, a toner (4) is prepared.

Example 5

The procedure for preparation of the toner (1) is repeated except the amount of the amorphous polyester (A1) is changed from 55 parts to 75 parts, and the amount of the amorphous polyester (B1) is changed from 20 parts to 10 parts. Thus, a toner (5) is prepared.

Comparative Example 1

The procedure for preparation of the toner (1) is repeated except the amorphous polyester (A1) is replaced with the amorphous polyester (A2). Thus, a comparative toner (6) is prepared.

Comparative Example 2

The procedure for preparation of the toner (1) is repeated except the amorphous polyester (B1) is replaced with the amorphous polyester (B2). Thus, a comparative toner (7) is prepared.

Comparative Example 3

The procedure for preparation of the toner (1) is repeated except the crystalline polyester (C1) is replaced with the crystalline polyester (C2). Thus, a comparative toner (8) is prepared.

Comparative Example 4

The procedure for preparation of the toner (1) is repeated except the crystalline polyester (C1) is replaced with the crystalline polyester (C3). Thus, a comparative toner (9) is prepared.

Comparative Example 5

The procedure for preparation of the toner (1) is repeated except the ethylenebis stearic acid amide (KAOWAX EB-FF from Kao Corporation, melting point of from 141.5 to 146.5° C.) is replaced with a stearic acid amide (FATTY AMIDE T from Kao Corporation, melting point of from 97 to 102° C.). Thus, a comparative toner (10) is prepared.

Comparative Example 6

The procedure for preparation of the toner (1) is repeated except the fatty acid amide is not added. Thus, a comparative toner (11) is prepared.

Comparative Example 7

The procedure for preparation of the toner (1) is repeated except the amount of the amorphous polyester (B1) is changed from 20 parts to 70 parts, the amount of the crystalline polyester (C1) is changed from 25 parts to 30 parts, and the amorphous polyester (A1) is not added. Thus, a comparative toner (12) is prepared.

Comparative Example 8

The procedure for preparation of the toner (1) is repeated except the amount of the amorphous polyester (A1) is changed from 55 parts to 80 parts, the amount of the crystalline polyester (C1) is changed from 25 parts to 20 parts, and the amorphous polyester (B1) is not added. Thus, a comparative toner (13) is prepared.

Comparative Example 9

The procedure for preparation of the toner (1) is repeated except the amount of the amorphous polyester (A1) is changed from 55 parts to 80 parts, and the crystalline polyester (C1) is not added. Thus, a comparative toner (14) is prepared.

The prepared toner compositions are shown in Table 4.

TABLE 4

| | Toner No. | Amorphous polyester A (parts) | Amorphous polyester B (parts) | Crystalline polyester C (parts) | Wax (parts) | Fatty acid amide (parts) |
|---|---|---|---|---|---|---|
| Ex. 1 | 1 | A1 (55) | B1 (20) | C1 (25) | Carnauba (3) | EB-FF (5) |
| Ex. 2 | 2 | A1 (55) | B1 (20) | C1 (25) | Polyethylene (3) | EB-FF (5) |
| Ex. 3 | 3 | A1 (55) | B1 (20) | C1 (25) | Carnauba (2) Polyethylene (2) | EB-FF (5) |
| Ex. 4 | 4 | A1 (65) | B1 (20) | C1 (10) | Carnauba (3) | EB-FF (5) |
| Ex. 5 | 5 | A1 (70) | B1 (10) | C1 (25) | Carnauba (3) | EB-FF (5) |
| Comp. Ex. 1 | 6 | A2 (55) | B1 (20) | C1 (25) | Carnauba (3) | EB-FF (5) |
| Comp. Ex. 2 | 7 | A1 (55) | B2 (20) | C1 (25) | Carnauba (3) | EB-FF (5) |
| Comp. Ex. 3 | 8 | A1 (55) | B1 (20) | C2 (25) | Carnauba (3) | EB-FF (5) |
| Comp. Ex. 4 | 9 | A1 (55) | B1 (20) | C3 (25) | Carnauba (3) | EB-FF (5) |
| Comp. Ex. 5 | 10 | A1 (55) | B1 (20) | C1 (25) | Carnauba (3) | FATTY AMIDE T (5) |
| Comp. Ex. 6 | 11 | A1 (55) | B1 (20) | C1 (25) | Carnauba (3) | — |
| Comp. Ex. 7 | 12 | — | B1 (70) | C1 (30) | Carnauba (3) | EB-FF (5) |
| Comp. Ex. 8 | 13 | A1 (80) | — | C1 (20) | Carnauba (3) | EB-FF (5) |
| Comp. Ex. 9 | 14 | A1 (80) | B1 (20) | — | Carnauba (3) | EB-FF (5) |

Evaluation 1

(1-1) Low temperature fixability

A developer is prepared by mixing 4 parts of a toner and 96 parts of a carrier (having a volume average particle diameter Dvc of 100 μm, and including carrier particles having a particle diameter of less than 0.4 times Dvc in an amount of 0.0% by weight, and carrier particles having a particle diameter of not less than 0.4 times and less than 0.6 times Dvc in an amount of 2.0% by weight) for 5 minutes using a TURBLA SHAKER MIXER.

The image forming apparatus 1 (illustrated in FIGURE) is modified so that the toner is used in an amount of 0.5 mg/cm$^2$ for developing an image having a size of 2 cm×12 cm on A4-size paper and unfixed images can be fixed outside the apparatus. The prepared developer is set in the developing device 8. The images are produced on papers (RICOPY PPC paper TYPE 6000 from Ricoh Co., Ltd.) and fixed by the fixing roller 21 at a temperature of 150° C. and a linear speed of 1500 mm/sec.

SCOTCH® TAPE (from Sumitomo 3M) is adhered to the fixed images, and peeled off after 3 hours left. The peeled tape is adhered to a white paper, and then image density is measured using X-RITE 938 (from X-rite, Incorporated). When the difference in image density between the peeled tape and the blank is 0.300 or more, it is considered that the image is not fixed. Low temperature fixability is graded by the difference in image density between the peeled tape and the blank as follows.

Good: less than 0.150

Average: not less than 0.150 and less than 0.300

Poor: not less than 0.300

(1-2) Hot Offset Resistance

The image forming apparatus 1 (illustrated in FIGURE) is further modified so that the toner is used in an amount of 1 mg/cm$^2$ for developing an image having a size of 2 cm×12 cm and unfixed images can be fixed outside the apparatus. The prepared developer is set in the developing device 8. The images are produced on papers (RICOPY PPC paper TYPE 6000 from Ricoh Co., Ltd.) and fixed by the fixing roller 21 at various temperatures (from 100° C. to 250° C. at an interval of 5° C.) and a linear speed of 250 mm/sec.

The fixed images are visually observed whether hot offset occurred or not. Hot offset resistance is graded by the temperature at which hot offset is observed as follows.

Good: not less than 250° C.

Average: not less than 200° C. and less than 250° C.

Poor: less than 200° C.

(1-3) Thermostable Preservability

Ten (10) g of each of the prepared toners is contained in a 100 ml glass bottle. The bottle is kept in a thermostatic chamber for 1 day at 50° C., followed by visual observation. Thermostable preservability is graded as follows:

Good: blocking is not observed

Average: soft caking state

Poor: hard caking state

The evaluation results of each of the toners are shown in Table 5.

TABLE 5

| | Toner No. | Low temperature fixability | Hot offset resistance | Thermostable preservability |
|---|---|---|---|---|
| Ex. 1 | 1 | Good | Average | Average |
| Ex. 2 | 2 | Average | Average | Average |
| Ex. 3 | 3 | Average | Good | Average |
| Ex. 4 | 4 | Average | Good | Good |
| Ex. 5 | 5 | Average | Good | Average |
| Comp. Ex. 1 | 6 | Poor | Good | Average |
| Comp. Ex. 2 | 7 | Poor | Good | Average |
| Comp. Ex. 3 | 8 | Poor | Average | Average |
| Comp. Ex. 4 | 9 | Poor | Average | Good |
| Comp. Ex. 5 | 10 | Average | Average | Poor |
| Comp. Ex. 6 | 11 | Average | Poor | Poor |

TABLE 5-continued

| | Toner No. | Low temperature fixability | Hot offset resistance | Thermostable preservability |
|---|---|---|---|---|
| Comp. Ex. 7 | 12 | Average | Poor | Good |
| Comp. Ex. 8 | 13 | Poor | Average | Good |
| Comp. Ex. 9 | 14 | Poor | Average | Average |

It is clear from Table 5 that each of the toners of the present invention (toners (1) to (5)) has a good combination of low temperature fixability, hot offset resistance, and thermostable preservability. In contrast, toners (6) to (9) have poor temperature fixability, toners (10) and (11) have poor thermostable preservability and/or hot offset resistance, and toners (12) to (14) have poor low temperature fixability or hot offset resistance.

Preparation of Carrier (1)

An aminosilane coupling agent i dispersed in a toluene in which a fluoric acrylic resin is diluted, to prepare a coating liquid. After heating the coating liquid, a particulate ferrite having a volume average particle diameter of 95 μm is spray-coated by the coating liquid using a spray coater. The coated ferrite is calcined and then cooled. Thus, carrier particles having a cover layer having an average thickness of 1.0 μm are prepared.

The carrier particles are classified so that the resultant carrier has a volume average particle diameter Dvc of 100 μm, and includes carrier particles having a particle diameter of less than 0.4 times Dvc in an amount of 0.0% by weight, and carrier particles having a particle diameter of not less than 0.4 times and less than 0.6 times Dvc in an amount of 2.0% by weight. Thus, a carrier (1) is prepared.

Preparation of Carrier (2)

The procedure for preparation of the carrier (1) is repeated except the sieving mesh is changed so that the resultant carrier includes carrier particles having a particle diameter of less than 0.4 times Dvc in an amount of 0.5% by weight, and carrier particles having a particle diameter of not less than 0.4 times and less than 0.6 times Dvc in an amount of 8.0% by weight. Thus a carrier (2) is prepared.

Preparation of Carrier (3)

An aminosilane coupling agent is dispersed in a toluene in which a fluoric acrylic resin is diluted, to prepare a coating liquid. After heating the coating liquid, a particulate ferrite having a volume average particle diameter of 35 μm is spray-coated by the coating liquid using a spray coater. The coated ferrite is calcined and then cooled. Thus, carrier particles having a cover layer having an average thickness of 1.0 μm are prepared.

The carrier particles are classified so that the resultant carrier has a volume average particle diameter Dvc of 35 μm, and includes carrier particles having a particle diameter of less than 0.4 times Dvc in an amount of 0.0% by weight, and carrier particles having a particle diameter of not less than 0.4 times and less than 0.6 times Dvc in an amount of 2.0% by weight. Thus, a carrier (3) is prepared.

Preparation of Carrier (4)

An aminosilane coupling agent is dispersed in a toluene in which a fluoric acrylic resin is diluted, to prepare a coating liquid. After heating the coating liquid, a particulate ferrite having a volume average particle diameter of 150 μm is spray-coated by the coating liquid using a spray coater. The coated ferrite is calcined and then cooled. Thus, carrier particles having a cover layer having an average thickness of 1.0 μm are prepared.

The carrier particles are classified so that the resultant carrier had a volume average particle diameter Dvc of 150 μm, and includes carrier particles having a particle diameter of less than 0.4 times Dvc in an amount of 0.0% by weight, and carrier particles having a particle diameter of not less than 0.4 times and less than 0.6 times Dvc in an amount of 2.0% by weight. Thus, a carrier (4) is prepared.

Example 6

A developer (1) is prepared by mixing 4 parts of the toner (1) prepared in Example 1 and 96 parts of the carrier (1) for 5 minutes using a TURBLA SHAKER MIXER.

Example 7

A developer (2) is prepared by mixing 4 parts of the toner (2) prepared in Example 2 and 96 parts of the carrier (1) for 5 minutes using a TURBLA SHAKER MIXER.

Example 8

A developer (3) is prepared by mixing 4 parts of the toner (3) prepared in Example 3 and 96 parts of the carrier (1) for 5 minutes using a TURBLA SHAKER MIXER.

Example 9

A developer (4) is prepared by mixing 4 parts of the toner (4) prepared in Example 4 and 96 parts of the carrier (1) for 5 minutes using a TURBLA SHAKER MIXER.

Example 10

A developer (5) is prepared by mixing 4 parts of the toner (5) prepared in Example 5 and 96 parts of the carrier (1) for 5 minutes using a TURBLA SHAKER MIXER.

Example 11

A developer (6) is prepared by mixing 4 parts of the toner (1) prepared in Example 1 and 96 parts of the carrier (2) for 5 minutes using a TURBLA SHAKER MIXER.

Example 12

A developer (7) is prepared by mixing 4 parts of the toner (2) prepared in Example 2 and 96 parts of the carrier (2) for 5 minutes using a TURBLA SHAKER MIXER.

Example 13

A developer (8) is prepared by mixing 4 parts of the toner (3) prepared in Example 3 and 96 parts of the carrier (2) for 5 minutes using a TURBLA SHAKER MIXER.

Example 14

A developer (9) is prepared by mixing 4 parts of the toner (4) prepared in Example 4 and 96 parts of the carrier (2) for 5 minutes using a TURBLA SHAKER MIXER.

Example 15

A developer (10) is prepared by mixing 4 parts of the toner (5) prepared in Example 5 and 96 parts of the carrier (2) for 5 minutes using a TURBLA SHAKER MIXER.

Example 16

A developer (11) is prepared by mixing 4 parts of the toner (1) prepared in Example 1 and 96 parts of the carrier (3) for 5 minutes using a TURBLA SHAKER MIXER.

Example 17

A developer (12) is prepared by mixing 4 parts of the toner (1) prepared in Example 1 and 96 parts of the carrier (4) for 5 minutes using a TURBLA SHAKER MIXER.

The prepared developer compositions are shown in Table 6.

TABLE 6

| | | | Carrier | | | |
|---|---|---|---|---|---|---|
| | Developer No. | Toner No. | No. | Dvc (μm) | <0.4 Dvc[1)] (% by weight) | ≧0.4Dvc, <0.6 Dvc[2)] (% by weight) |
| Ex. 6 | 1 | 1 | 1 | 100 | 0.0 | 2.0 |
| Ex. 7 | 2 | 2 | | | | |
| Ex. 8 | 3 | 3 | | | | |
| Ex. 9 | 4 | 4 | | | | |
| Ex. 10 | 5 | 5 | | | | |
| Ex. 11 | 6 | 1 | 2 | 100 | 0.5 | 8.0 |
| Ex. 12 | 7 | 2 | | | | |
| Ex. 13 | 8 | 3 | | | | |
| Ex. 14 | 9 | 4 | | | | |
| Ex. 15 | 10 | 5 | | | | |
| Ex. 16 | 11 | 1 | 3 | 35 | 0.0 | 2.0 |
| Ex. 17 | 12 | 1 | 4 | 150 | 0.0 | 2.0 |

<0.4 Dvc[1)]amount of carrier particles having a particle diameter of less than 0.4 times Dvc ≧0.4 Dvc, <0.6 Dvc[2)]amount of carrier particles having a particle diameter of not less than 0.4 times and less than 0.6 times Dvc Evaluation 2

(2-1) Low Temperature Fixability

Each of the developers (1) to (12) is set in the developing device 8, and the evaluation described in the above (1-1) is performed.

(2-2) Hot Offset Resistance

Each of the developers (1) to (12) is set in the developing device 8, and the evaluation described in the above (1-2) is performed.

(2-3) Thermostable Preservability

Each of the developers (1) to (12) is set in the developing device 8, and the evaluation described in the above (1-3) is performed.

(2-4) Carrier Adherence

The image forming apparatus (illustrated in FIGURE) is modified so that images can be formed on A4-size papers. Each of the developers (1) to (12) is set in the developing device 8, and 1,000 sheets of solid images are produced on papers (RICOPY PPC paper TYPE 6000 from Ricoh Co., Ltd.) at a linear speed of 1500 mm/sec.

The produced images are visually observed whether carrier adherence occurs or not. The images are graded as follows.

Good: carrier adherence is not observed

Poor: carrier adherence is observed (2-5) Image Quality of Half-tone Image

The image forming apparatus (illustrated in FIGURE) is modified so that images can be formed on A4-size papers. Each of the developers (1) to (12) is set in the developing device 8, and 15,000 sheets of half-tone images are produced on papers (RICOPY PPC paper TYPE 6000 from Ricoh Co., Ltd.) at a linear speed of 1500 mm/sec.

The produced images are visually observed whether the half-tone image is uneven or not. The images are graded as follows.

Good: Unevenness is not observed. Very good half-tone image reproducibility.

Average: A small amount of unevenness is observed. Good half-tone image reproducibility.

Poor: A large amount of unevenness is observed. Poor half-tone image reproducibility.

The evaluation results are shown in Table 7.

TABLE 7

| | Developer No. | Low temperature fixability | Hot offset resistance | Thermo-stable preserve-ability | Carrier adherence | Half-tone image quality |
|---|---|---|---|---|---|---|
| Ex. 6 | 1 | Good | Average | Average | Good | Average |
| Ex. 7 | 2 | Average | Average | Average | Good | Average |
| Ex. 8 | 3 | Average | Good | Average | Good | Average |
| Ex. 9 | 4 | Average | Good | Good | Good | Average |
| Ex. 10 | 5 | Average | Good | Average | Good | Average |
| Ex. 11 | 6 | Good | Average | Average | Poor | Average |
| Ex. 12 | 7 | Average | Average | Average | Poor | Average |
| Ex. 13 | 8 | Average | Good | Average | Poor | Average |
| Ex. 14 | 9 | Average | Good | Good | Poor | Average |
| Ex. 15 | 10 | Average | Good | Average | Poor | Average |
| Ex. 16 | 11 | Good | Average | Average | Poor | Good |
| Ex. 17 | 12 | Good | Average | Average | Good | Poor |

It is clear from Table 7 that each of the developers (1) to (12) has a good combination of low temperature fixability, hot offset resistance, and thermostable preservability. In particular, each of the developers (1) to (5) does not cause carrier adherence and produce high quality half-tone images even if the image forming speed is high.

This document claims priority and contains subject matter related to Japanese Patent Application No. 2005-223521, filed on Aug. 1, 2005, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin;

a release agent;

a colorant; and a fatty acid amide compound, wherein the binder resin comprises:

an amorphous polyester (A) having a softening point of from 70 to 140° C.;

an amorphous polyester (B) having a softening point of from 120 to 190° C.; and a crystalline polyester (C), wherein the crystalline polyester (C) forms a domain in the toner, wherein at least a part of the fatty acid amide compound is include in the domain;

and wherein the following relationship is satisfied:

$$TmC<Tm(Asp)$$

wherein TmC represents a softening point of the crystalline polyester (C) and Tm(Asp) represents a softening point of the fatty acid amide compound.

2. The toner according to claim 1, which satisfies the following relationship:

$$TmA<TmB-10^\circ\ C.$$

wherein TmA represents a softening point of the amorphous polyester (A) and TmB represents a softening point of the amorphous polyester (B).

3. The toner according to claim 1, which satisfies the following relationship:

$$TmC-40^\circ\ C.\leqq TmA\leqq TmC$$

wherein TmA represents a softening point of the amorphous polyester (A).

4. The toner according to claim 1, wherein the crystalline polyester (C) has a softening point of from 80 to 140° C.

5. The toner according to claim 1, wherein the amorphous polyester (B) has a viscoelastic property such that a ratio (G'100/G'150) between a storage elastic modulus (G'100) at 100° C. and a storage elastic modulus (G'150) at 150° C. is from 3.0 to 30.0.

6. The toner according to claim 1, wherein the toner has a glass transition temperature of from 35 to 70° C.

7. The toner according to claim 1, wherein the fatty acid amide compound is an alkylenebis fatty acid amide.

8. The toner according to claim 1, wherein the fatty acid amide compound is an ethylenebis stearic acid amide.

9. The toner according to claim 1, wherein the toner is manufactured by a method comprising:

melt-kneading a toner constituent mixture comprising the binder resin, the release agent, the colorant, and the fatty acid amide compound; and pulverizing the melt-kneaded mixture.

10. The toner according to claim 1, wherein the release agent comprises two waxes, at least one of said two waxes being a hydrocarbon wax.

11. The toner according to claim 1, wherein at least one of the amorphous polyester (A) and the amorphous polyester (B) is manufactured by using a catalyst selected from the group consisting of inorganic tin compounds and titanium-containing compounds.

12. The toner according to claim 1, wherein the crystalline polyester (C) is manufactured by using a catalyst selected from the group consisting of inorganic tin compounds and titanium-containing compounds.

13. A developer, comprising:

a toner; and a carrier, wherein the carrier comprises:

a magnetic core; and a resin layer overlying the magnetic core, wherein the toner is the toner according to claim 1.

14. The developer according to claim 13, wherein (a) the carrier has a volume average particle diameter (Dvc) of from 50 to 125 μm, (b) the carrier comprises carrier particles having a particle diameter of less than 0.4 times the Dvc in an amount of not greater than 0.1% by weight, and (c) the carrier includes carrier particles having a particle diameter of not less than 0.4 times and less than 0.6 times the Dvc in an amount of not greater than 4.0% by weight.

* * * * *